United States Patent [19]

Rasch

[11] Patent Number: 4,934,162

[45] Date of Patent: Jun. 19, 1990

[54] LATCH FOR LUGGAGE OR POCKETBOOK

[75] Inventor: Ulf Rasch, Iserlohn, Fed. Rep. of Germany

[73] Assignee: Sudhaus Schloss- Und Beschlagtechnik GmbH & Co., Iserlohn, Fed. Rep. of Germany

[21] Appl. No.: 310,064

[22] Filed: Feb. 10, 1989

[30] Foreign Application Priority Data

Apr. 9, 1988 [DE] Fed. Rep. of Germany ... 8804700[U]

[51] Int. Cl.[5] ..... E05B 65/52; E05C 1/10

[52] U.S. Cl. ..... 70/69; 292/162; 292/175; 292/252

[58] Field of Search ..... 292/156, 162, 163, 175, 292/252, DIG. 30, DIG. 37; 70/69–76

[56] References Cited

U.S. PATENT DOCUMENTS

| | | | |
|---|---|---|---|
| 853,358 | 5/1907 | Hammar | 292/162 |
| 1,702,621 | 2/1929 | Stelljes | 292/162 |
| 3,294,206 | 12/1966 | Gehrie | 292/162 |
| 3,498,659 | 3/1970 | Ammon | 292/162 |
| 4,239,269 | 12/1980 | Chiang | 292/175 |
| 4,356,712 | 11/1982 | Bako | 70/69 |
| 4,652,029 | 3/1987 | Yamamoto | 292/252 |

*Primary Examiner*—Robert L. Wolfe

*Attorney, Agent, or Firm*—Herbert Dubno; Andrew Wilford

[57] ABSTRACT

A latch for securing together two relatively movable parts of a suitcase, pocketbook, or the like, has a latch housing secured to one of the parts and formed internally with a retaining guide, a strike secured to the other of the parts and engageable in the housing on juxtaposition of the two parts, and a button displaceable on the housing between an outer position and an inner position. The button is formed unitarily with a latching dog retainingly engageable with the strike when same is engaged in the housing and the button is in the outer position and with a retaining formation engaged inward of the retaining guide and preventing removal of the button from the housing. A spring is braced between the housing and the button and urges the button into the outer position.

9 Claims, 2 Drawing Sheets

LATCH FOR LUGGAGE OR POCKETBOOK

FIELD OF THE INVENTION

The present invention relates to a latch of the type used on a piece of luggage, pocketbook, briefcase, or the like.

BACKGROUND OF THE INVENTION

A standard piece of luggage has a body provided on one edge with a latch and hinged to a cover or other body part that has an edge provided with a strike retainable by the latch to hold the piece of luggage or the like closed. The latch has a housing in which a release button is displaceable against the force of a spring. A retaining dog coupled to the release button can be moved thereby between a position engaging and retaining the strike and a position allowing the strike to move out of the latch.

As a rule such a latch is a fairly complex piece of equipment comprised of many parts that must be carefully manufactured and fitted together. As a result the cost of a pocketbook, piece of luggage, briefcase, or the like equipped with such a latch can be elevated simply by the cost of the latch itself, even when the item is otherwise intended to be inexpensive.

OBJECTS OF THE INVENTION

It is therefore an object of the present invention to provide an improved latch for a suitcase or the like.

Another object is the provision of such an improved latch for a suitcase or the like which overcomes the above-given disadvantages, that is which is of simple and inexpensive construction while not lacking any of the features of more complicated and expensive such latches.

SUMMARY OF THE INVENTION

A latch for securing together two relatively movable parts of a suitcase, pocketbook, or the like, has according to this invention a latch housing secured to one of the parts and unitarily formed internally with a retaining guide, a strike secured to the other of the parts and engageable in the housing on juxtaposition of the two parts, and a button displaceable on the housing between an outer position and an inner position. The button is formed unitarily with a latching dog retainingly engageable with the strike when same is engaged in the housing and the button is in the outer position and with a retaining formation engaged inward of the retaining guide and preventing removal of the button from the housing. A spring is braced between the housing and the button and urges the button into the outer position. The retaining formation of this instant invention is a dog tab projecting from the button and unitarily formed therewith.

The latch of this invention therefore comprises four basic pieces: the housing, the button, the spring, and the strike. As a result the latch can be made at extremely low cost both as regards the cost of making its parts and assembling it. Even though of such simple construction, however, it functions as well as the more complex prior-art systems.

In order to provide a simple system for preventing the case or the like equipped from this invention from being opened when upside down, the housing is formed with a cavity open toward the button and provided with a ball of substantially smaller outside dimension than the inside dimension of the cavity, the button being formed with a projection engageable with the ball to prevent displacement of the button into the inner position only when the latch is upside down, the ball being out of the path of the projection when the latch is right side up. This cavity has a floor that is inclined at an angle to a transverse displacement direction of the button between its positions and is angled downward away from the button in an right-side-up position of the latch and is positioned such that in an upside-down position of the latch and outer position of the button the ball engages both the floor of the cavity and the projection of the button.

Furthermore the latch can be made key-operable simply by providing the button with a rotary key-operated locking member braced between the button and the spring. This locking member is generally cylindrical and is formed with spring-engaging bumps and the housing is formed with a projecting pin having an outer end engageable by a key inserted into the locking member.

In order to make the case or the like pop open when the release button is depressed, the housing is provided with a second spring separate from the first-mentioned spring and positioned in the housing so as to urge the strike therefrom.

Furthermore construction is simplified when the housing has one end formed with a gudgeon, an end of a handle being engageable in the gudgeon, and the housing has an opposite end formed with a tab engaging under the one part.

DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
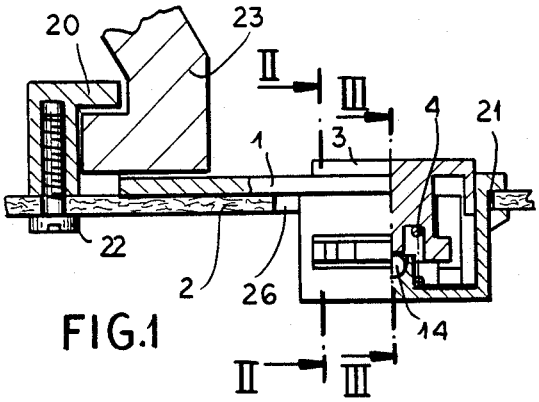
FIG. 1 is a longitudinal section through a first embodiment of the latch according to this invention.

As seen in FIGS. 1 through 4, 11, and 12 a suitcase 2, 6 according to this invention has a body 2 to which is fitted a latch housing 1 and a cover 6 to which is fixed a strike 5. The housing 1 is formed as a parallepipedal cup with a rim resting on the outside of the body 2 of the case 2, 6 and is fitted with a large square depressible release button 3 that is urged outward by a coil spring 4. The release button 3 fits like a piston in the housing 1 and is formed on each of its opposite longitudinal sides with a longitudinal groove 24 defining an end ridge 11 and receiving a respective integral ridge 12 of the inner longitudinal wall surface of the housing 1. The inner end of the button 3 is hollow so its sides can be deflected inward to allow the ridge 12 to snap into the groove 24, and so that once thus fitted together the ridge 12 and groove 24 allow transverse displacement of the button 3 with concomitant compression of the spring 4. These formations 11, 12, and 24 therefore accurately anchor the button 3 on the housing 1 while permitting the button 3 to move between inner and outer positions.

Figure 2:
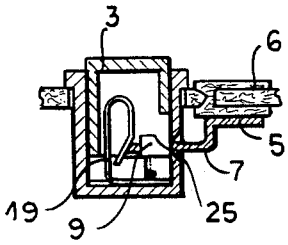
FIG. 2 and 3 are cross-sections taken along respective lines II—II and III—III of FIG. 1, FIG. 3 being rotated through 90 degrees relative to FIG. 2 and shown right side up.

The strike 5 is formed with a tongue 7 that can engage through a slot 25 into the side of the housing 1 and that is formed with an aperture or cutout 10 into which a dog 9 formed integrally with the button 3 can engage. This dog 9 as seen in FIG. 2 has an outer flank that is inclined so that pushing the tongue 7 into the slot 25 will cam the button 3 inward, but its inner flank is perpendicular to the tongue 7 so that once the spring 4 snaps the button 3 back out, the tongue 7 will be effectively locked by this dog 9 and prevented from pulling out of the housing 1. On entering the slot 25 the tongue 7 engages and deforms a leaf spring 19 so that, when the button 3 is depressed sufficiently to push the dog 9 out of the aperture 10, this spring 19 pushes the tongue 7 out and, therefore, pops up the cover 6.

Figure 3:
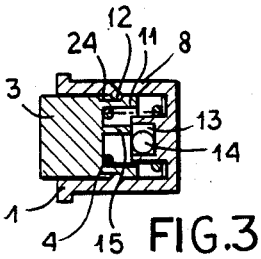
Figure 4:
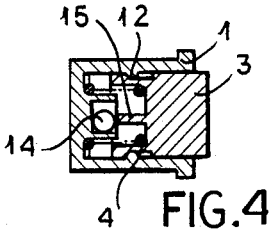
FIG. 4 is a cross section taken along the same plane of FIG. 3 but with the latch upside down.
Figure 5:
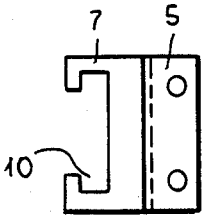
FIG. 5 is a top view of the strike of the first embodiment.
Figure 6:
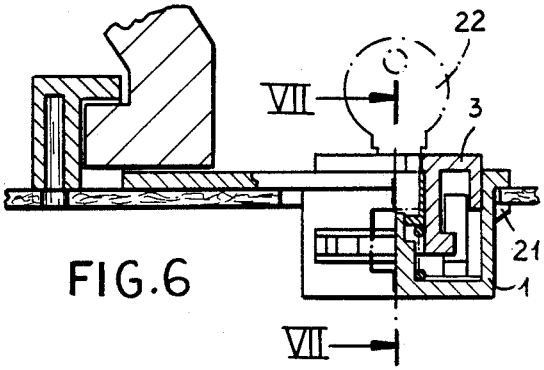
FIG. 6 is a view like FIG. 1 of a second embodiment of the latch according to this invention.
Figure 7:
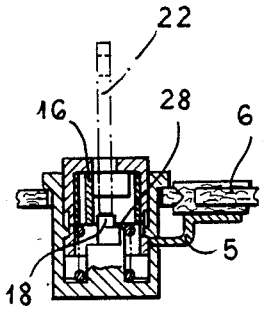
FIG. 7 is a section taken along line VII—VII of FIG. 6.
Figure 8:
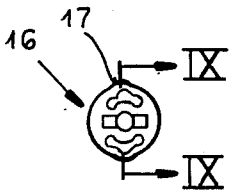
FIG. 8 is a top view of a detail of the second embodiment.
Figure 9:
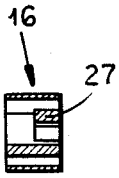
FIG. 9 is a section taken along line IX—IX of FIG. 8.
Figure 10:
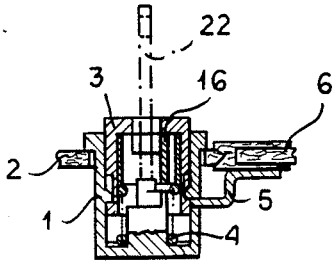
FIG. 10 is a view like FIG. 7 but showing the latch in the closed position.

In order to prevent the case 2, 6 from being opened when upside down the base of the housing 1 is formed within the spring 4 with an outwardly open cup 13 defining a cavity holding a ball 14 whose outside diameter is about two-thirds the inside diameter of the cup 13. The button 3 in turn is formed with an offcenter tongue or projection 15 that engages on depression of this button 3 into the cup 13 adjacent its upper side, around one-sixth of the way across. Thus when the case 2, 6 is right side up as seen in FIG. 3 the ball 14 will be below the tongue 15 so that same can poke into the cup 13 and, therefore, allow the button 3 to be depressed sufficiently to release the strike 5. When, however, as shown in FIG. 4 the case 2, 6 is upside down, the ball 14 will block insertion of the tongue 15 into the cup 13 and, therefore, will prevent unlatching of the case. This is a valuable safety feature to prevent the user from opening his or her case when it is upside down and thereby dumping out its contents. The floor of the cavity formed by the cup 13 is not perpendicular to the transverse displacement direction of the button 3; instead it is angled somewhat away from the button 3 in the right-side-up position. Thus the ball 14 is tightly wedged against the projecting pin 15 in the upside-down position as shown in FIG. 4.

Figure 11:
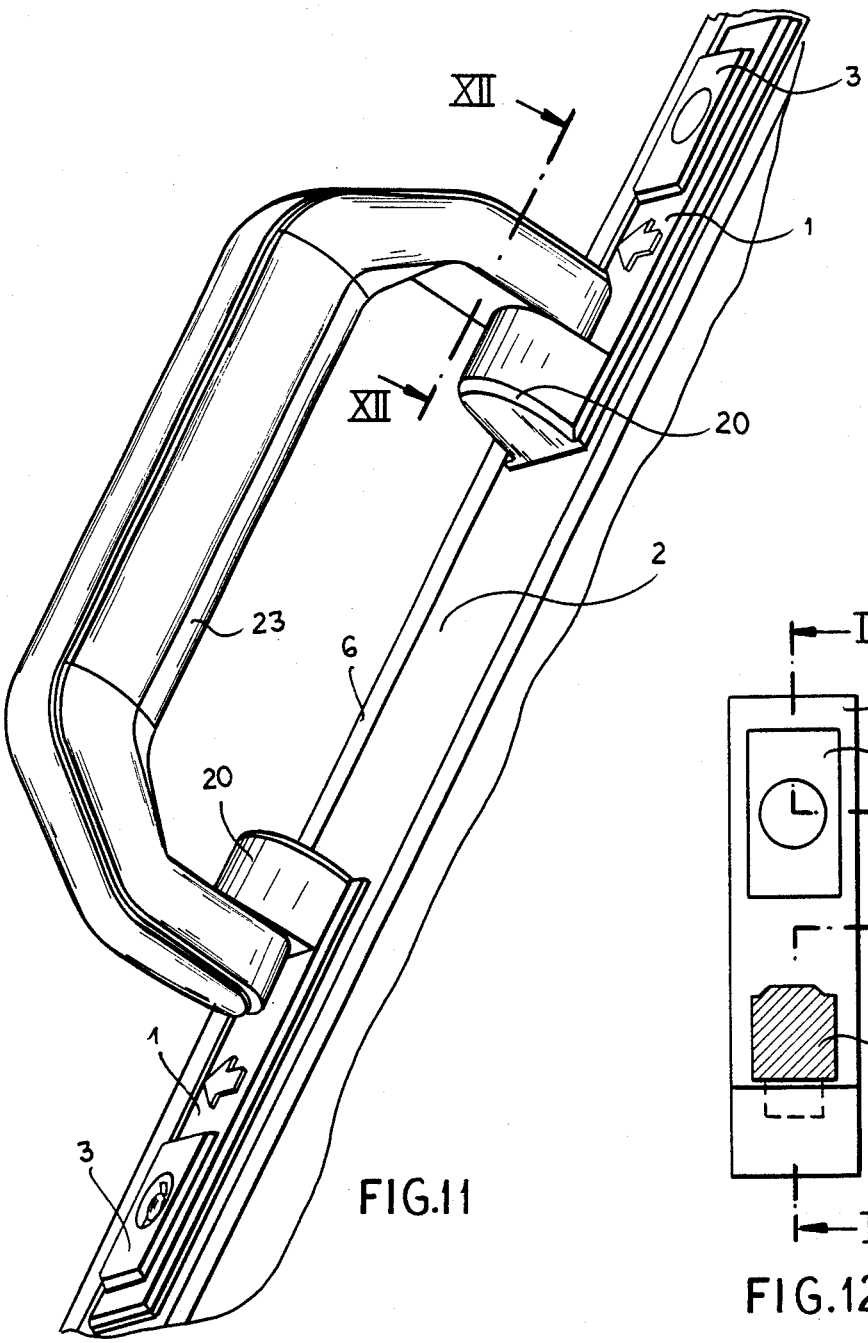
FIG. 11 is a perspective view of the first embodiment of the latch.
Figure 12:
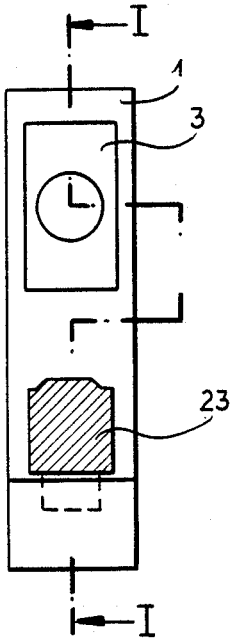
FIG. 12 is a section taken along line XII—XII of FIG. 1, line I—I indicating the section plane for FIG. 1.

As shown in FIG. 11 the adjacent ends of the housings 1 are formed with gudgeons 20 into which the ends of a handle 23 can engage. Furthermore the opposite ends of the housings 1 are formed as forks with inner tabs 21 as seen in FIG. 1 so that these housings 1 can be simply mounted by fitting them through respective holes 26 in the body 2, then fitting the pins of the handle 23 into the gudgeons 20, and then sliding the two housings 1 apart and securing them in place with screws 22 through the gudgeons 20. Thus installation and, if necessary, removal and replacement of the latch is extremely easy.

FIGS. 6 through 10 show an arrangement identical to that of FIGS. 1 through 5, 11, and 12 except that it can be locked and unlocked by a key 22. To this end a cylindrical rotary lock member or sleeve 16 is provided whose outer end bears against the inner face of the button 3 and whose inner end against the spring 4, so that the spring 4 bears via this member 16 on the button 3. Externally this member 16 is formed with bumps 17 that center it in the spring 4 and internally with an offcenter part 27 that can, in one angular position of the member 16, engage a shoulder 28 of the housing 1 and thereby prevent depression of the button 3. The housing 1 is formed adjacent the shoulder 28 with a pin 18 against which the end of the key 22 engages to prevent the key 22 from depressing this member 16. The key 22 can therefore only rotate the member 16, not depress it.

I claim:

1. A latch for securing together two relatively movable parts of a suitcase, pocketbook, or the like, the latch comprising:

a one-piece latch housing secured to one of the parts and formed internally with a retaining guide;

a strike secured to the other of the parts and engageable in the housing on juxtaposition of the two parts;

a button displaceable on the housing between an outer position and an inner position and formed unitarily with a latching dog retainingly engageable with the strike when same is engaged in the housing and the button is in the outerposition, and with a dog tab projecting from the button, unitarily formed therewith, engaged inward of the retaining guide, and preventing removal of the button from the housing; and a spring braced between the housing and the button and urging the button into the outer position.

2. A latch for securing together two relatively movable parts of a suitcase, pocketbook, or the like, the latch comprising:

a latch housing secured to one of the parts and formed internally with a retaining guide;

a strike secured to the other of the parts and engageable in the housing on juxtaposition of the two parts;

a button displaceable on the housing between an outer position and an inner position, the housing being formed with a cavity open toward the button and provided with a ball of substantially smaller outside dimension than the inside dimension of the cavity, the button being formed with a projection engageable with the ball to prevent displacement of the button into the inner position only when the latch is upside down, the ball being out of the path of the projection when the latch is right side up, the button being formed unitarily with a latching dog retainingly engageable with the strike when same is engaged in the housing and the button is in the outer position, and with a dog tab projecting from the button, unitarily formed therewith, engaged inward of the retaining guide, and preventing removal of the button from the housing; and a spring braced between the housing and the button and urging the button into the outer position.

3. The latch defined in claim 2 wherein the cavity has a floor that is inclined at an angle to a transverse displacement direction of the button between its positions and is angled downward away from the button in an right-side-up position of the latch and is positioned such that in an upside-down position of the latch and outer position of the button the ball engages both the floor of the cavity and the projection of the button.

4. A latch for securing together two relatively movable parts of a suitcase, pocketbook, or the like, the latch comprising:

a latch housing secured to one of the parts and formed internally with a retaining guide;

a strike secured to the other of the parts and engageable in the housing on juxtaposition of the two parts;

a button displaceable on the housing between an outer position and an inner position, the button being provided with a rotary key-operated locking member braced between the button and the spring, the button being formed unitarily with a latching dog retainingly engageable with the strike when same is engaged in the housing and the button is in the outer position, and with a retaining formation engaged inward of the retaining guide, and preventing removal of the button from the housing; and a spring braced between the housing and the button and urging the button into the outer position.

5. The latch defined in claim 4 wherein the locking member is generally cylindrical and is formed with spring-engaging bumps.

6. The latch defined in claim 5 wherein the housing is formed with a projecting pin having an outer end engageable by a key inserted into the locking member.

7. A latch for securing together two relatively movable parts of a suitcase, pocketbook, or the like, the latch comprising:

a latch housing secured to one of the parts and formed internally with a retaining guide;

a strike secured to the other of the parts and engageable in the housing on juxtaposition of the two parts;

a button displaceable son the housing between an outer position and an inner position and formed unitarily with a latching dog retainingly engageable with the strike when same is engaged in the housing and the button is in the outer position, and with a retaining formation engaged inward of the retaining guide, and preventing removal of the button from the housing;

a spring braced between the housing and the button and urging the button into the outer position; and a second spring separate from the first-mentioned spring and positioned in the housing so as to urge the strike therefrom.

8. A latch for securing together two relatively movable parts of a suitcase, pocketbook, or the like, the latch comprising:

a latch housing secured to one of the parts and formed internally with a retaining guide, the housing having one end formed with a gudgeon, an end of a handle being engageable in the gudgeon;

a strike secured to the other of the parts and engageable in the housing on juxtaposition of the two parts;

a button displaceable on the housing between an outer position and an inner position and formed unitarily with a latching dog retainingly engageable with the strike when same is engaged in the housing and the button is in the outer position, and with a retaining formation engaged inward of the retaining guide, and preventing removal of the button from the housing; and a spring braced between the housing and the button and urging the button into the outer position.

9. The latch defined in claim 8 wherein the housing has an opposite end formed with a tab engaging under the one part.

* * * * *